US006435392B1

(12) United States Patent
Kennedy

(10) Patent No.: US 6,435,392 B1
(45) Date of Patent: Aug. 20, 2002

(54) WATERPROOF SWIMMING POUCH

(76) Inventor: Linda Kennedy, P.O. Box 630398, Park City, UT (US) 84068

( * ) Notice: Subject to any disclaimer, the term of this patent is extended or adjusted under 35 U.S.C. 154(b) by 0 days.

(21) Appl. No.: 09/098,609

(22) Filed: Jun. 17, 1998

Related U.S. Application Data

(63) Continuation-in-part of application No. 08/866,917, filed on May 30, 1997, now Pat. No. 5,775,561, which is a division of application No. 08/183,918, filed on Jan. 19, 1994, now Pat. No. 5,645,205, which is a continuation of application No. 07/803,128, filed on Dec. 4, 1991, now abandoned.

(51) Int. Cl.[7] ..... A45C 1/04

(52) U.S. Cl. ..... 224/680; 224/676; 224/683; 224/277; 224/901.8

(58) Field of Search ..... 224/676, 680, 224/682, 683, 436, 437, 439, 219, 222, 277, 901.8; D3/221, 226, 230, 319, 215

(56) References Cited

U.S. PATENT DOCUMENTS

| | | | | | |
|---|---|---|---|---|---|
| 1,559,270 | A | * | 10/1925 | Miller | 224/676 |
| 1,920,061 | A | * | 7/1933 | Carr | 224/235 X |
| 2,072,564 | A | * | 3/1937 | May | 383/111 X |
| 2,107,216 | A | * | 2/1938 | Rogers | 383/113 X |
| 3,485,281 | A | * | 12/1969 | Wicks | 383/111 X |
| 3,980,070 | A | * | 9/1976 | Krupa | 383/111 X |
| D261,196 | S | * | 10/1981 | Griffin | |
| D265,149 | S | * | 6/1982 | Romano | D3/319 |
| 4,420,097 | A | * | 12/1983 | Motsenbocker | 224/148 |
| D278,761 | S | * | 5/1985 | Fuller | |
| 4,637,063 | A | * | 1/1987 | Sullivan et al. | 383/113 X |
| D300,786 | S | * | 4/1989 | Josselyn | 224/901.2 |
| 4,871,597 | A | * | 10/1989 | Hobson | |
| 4,905,857 | A | * | 3/1990 | Her | |
| 4,928,793 | A | * | 5/1990 | Westimayer et al. | 108/152 |
| 4,951,666 | A | * | 8/1990 | Inman et al. | 383/901 X |
| 5,012,964 | A | * | 5/1991 | Falletta et al. | 224/153 |
| 5,060,835 | A | * | 10/1991 | Payne | 224/224 |
| 5,074,300 | A | * | 12/1991 | Murphy | 383/901 X |
| 5,096,103 | A | * | 3/1992 | Baugh | 224/151 |
| 5,114,061 | A | * | 5/1992 | Brady | 224/252 |
| 5,150,824 | A | * | 9/1992 | Alvarez et al. | 224/151 |
| 5,170,917 | A | * | 12/1992 | Tourigny | 224/219 |
| 5,178,311 | A | * | 1/1993 | McBride | 224/191 |
| D334,471 | S | * | 4/1993 | Yerby et al. | D3/226 |
| 5,244,136 | A | * | 9/1993 | Callaso | 224/235 |
| D340,806 | S | * | 11/1993 | Gonzalez | D3/226 |
| 5,285,833 | A | * | 2/1994 | Haxby | 150/102 |
| 5,732,978 | A | * | 3/1998 | Tunnell, IV | 283/34 |
| 5,884,338 | A | * | 3/1999 | Golde | 2/247 |
| 6,065,421 | A | * | 5/2000 | Haller et al. | 114/345 |
| 6,223,678 | B1 | * | 5/2001 | Haller et al. | 114/345 |
| 6,305,590 | B1 | * | 10/2001 | Hayes | 190/110 |

FOREIGN PATENT DOCUMENTS

| | | | | |
|---|---|---|---|---|
| CA | 1078797 | * | 6/1980 | 224/240 |
| FR | 2522484 | * | 9/1983 | D3/226 |
| FR | 2590458 | * | 5/1987 | 224/153 |

OTHER PUBLICATIONS

Fanny Pack and Insulated Container, Bass Pro Shops Catalog, 1990, p. 356.*

Various Fanny Packs, Bow Hunters Catalog, Spring, 1986, p. 66.*

Fanny Pack PB–9, M.G.B. Industrial Co., Ltd. Advertisement, Hong Kong Enterprises Magazine, Oct., 1989, p. 485.*

* cited by examiner

*Primary Examiner*—Stephen K. Cronin
(74) *Attorney, Agent, or Firm*—John F. A. Earley; John F. A. Earley, III; Harding, Earley, Follmer, & Frailey

(57) ABSTRACT

A lightweight waterproof pouch for carrying personal objects such as cash, a watch, credit cards, a wallet, and the like in a wet environment and for keeping those objects safe and dry comprises an outer enclosure formed of flexible material, a removable, resealable, waterproof inner pouch liner for insertion into the outer enclosure, and a strap attached to the outer enclosure for holding the pouch around a wearer's body. The inner pouch liner forms a watertight compartment when closed for keeping the personal objects dry.

9 Claims, 4 Drawing Sheets

WATERPROOF SWIMMING POUCH

CROSS-REFERENCE TO RELATED APPLICATIONS

This is a continuation-in-part of U.S. patent application Ser. No. 08/866,917, now U.S. Pat. No. 5,775,561, filed May 30, 1997 which is a division of U.S. patent application Ser. No. 08/183,918, now U.S. Pat. No. 5,645,205, filed on Jan. 19, 1994, which is a continuation of U.S. patent application Ser. No. 07/803,128, filed on Dec. 4, 1991, now abandoned, all three of which are incorporated herein by reference.

FIELD OF THE INVENTION

The present invention relates to a comfortable and safe way to carry personal belongings in a nonbreakable waterproof swimming pouch, enabling its users to enjoy all water activities available by allowing them to give their undivided attention to their surroundings, without the fear that usually comes with the possible theft of one's cash, watch, credit cards, and wallet when left unattended on land, and at the same time enabling its users to feel attractive while wearing the aesthetically appealing waterproof pouch with swim wear.

DESCRIPTION OF PRIOR ART

Water sports for the water sports enthusiast are usually performed with one eye on the beach watching the personal items that have been stored on the beach in a towel, hidden in the sand or a sneaker, unless one is fortunate enough to have a friend offer to give up their fun and stay behind and act as a watch guard. Many vacationing couples split water time because there is not a lightweight, safe, convenient, shatterproof, as well as aesthetically appealing, means to carry their personal items along with them.

While a diving box may exist, Her U.S. Pat. No. 4,905,857, it will hardly be the choice of the casual swimmer or water sports enthusiast. Who would choose a cumbersome, expensive, breakable and therefore unsafe and hazardous, means to carry personal items around one's waist while actually engaging in a sport where only fun is on the mind? In addition, the diving box is strictly functional, whereas the waterproof swimming pouch is a pleasure to the eye since said waterproof swimming pouch is made in coordinating colors and patterns to swim wear, rests lightly and comfortably on the hip, almost undetected by the wearer, and acts as part of the swimming dress.

SUMMARY OF THE INVENTION

The present invention was developed out of a need to provide a means for safe keeping the personal belongings of the water sports enthusiast. The invention fulfills this need, and, at the same time, remains aesthetically appealing.

The waterproof swimming pouch is provided with an outer enclosure made of a lightweight, colored, patterned, and coordinated material such as nylon, cotton, polyester, or other known fabric materials. The enclosure material can be chosen to match all bathing apparel.

The waterproof swimming pouch is also provided with a resealable removable inner pouch liner that serves to waterproof the personal belongings of the sports enthusiast. Said inner pouch liner is made of durable waterproof material and shaped to fit the outer enclosure, and is provided with a resealable interlocking closure at the top of the inner pouch liner. Inner pouch will supply the means of water proof.

The present invention also provides a waterproof map case. The map case comprises a first enlarged pouch formed of a flexible, transparent material. The first pouch has a waterproof, flexible pouch liner inside the first pouch. The pouch liner has a resealable, interlocking, watertight closure means which forms a watertight compartment inside the first pouch for keeping the map dry.

The map case also has a second, smaller pouch for holding map accessories. The second pouch is formed of a flexible, transparent material and also has a waterproof, flexible pouch liner inside the second pouch. The pouch liner has a resealable, interlocking, watertight closure means which forms a watertight compartment inside the second pouch for keeping the accessories dry.

The smaller, second pouch is preferably releasably fastened to the outside of the first pouch by means of velcro tab fasteners. The first pouch also includes resealable connectors, such as closed-loop hooks, at each corner of the first pouch.

The present invention further provides a waterproof backpack and waterproof waist bag each of which have a first, main pouch formed of a flexible material and a second auxiliary pouch also formed of flexible material. The second pouch has a waterproof, flexible pouch liner inside the second pouch. The pouch liner has a resealable, interlocking, watertight closure means which forms a watertight compartment inside the second pouch for keeping the contents dry. In the backpack of the present invention, the second pouch is fixed to the outside of the first pouch. In the waist bag of the present invention, the second pouch is fixed to the inside of the first pouch.

DETAILED DESCRIPTION OF THE DRAWINGS

Figure 1:
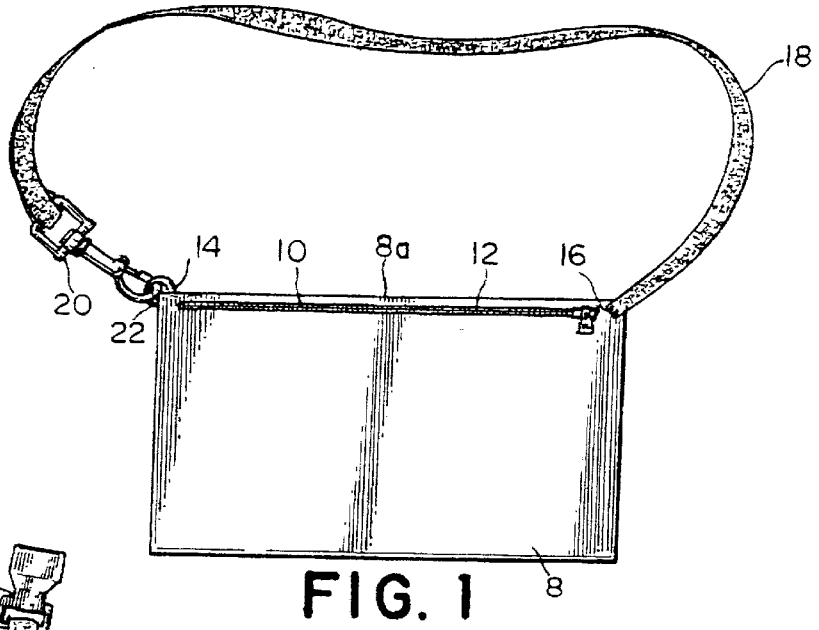
FIG. 1 is a perspective frontal view of a rectangular version of the waterproof swimming pouch constructed in accordance with the invention.

Turning to FIG. 1, enclosure 8 forms a jacket completely surrounding a waterproof resealable inner pouch liner (not shown). Enclosure 8 is formed in a rectangular shape, although any geometrical shape may be used. In the preferred embodiment, the enclosure is made of a woven fabric of a particular weave wherein the material can be cotton, nylon, polyester, or other known fabric materials. Opening 10 extends horizontally across the upper edge 8*a* of enclosure 8. Closure means 12, which in the preferred embodiment is a zipper, is fixed in opening 10 to enable opening and closing of opening 10. Snaps, buttons, or VELCRO (a trademark of VELCRO USA, Inc.) strips and other closing devices may be used as closure means 12.

Strap 18 may be made from any convenient strap material and is used to attach enclosure 8 around a wearer's waist. Strap 18 is attached to the right and left upper end portion of enclosure 8. In FIG. 1, the strap end 16 of strap 18 is sewn in place, although a buckle means may be used, and strap end 14 is attached to enclosure 8 by a buckle 20 and eye 22. Buckle 20 and eye 22 interlock with one another to secure strap end 14 to enclosure 8, and may be disengaged from each other for detaching strap end 14 from enclosure 8. Buckle 20 and eye 22 can be made in a variety of different ways as will be obvious to persons skilled in the art and may be made from conventional materials such as plastic or metals.

Figure 2:
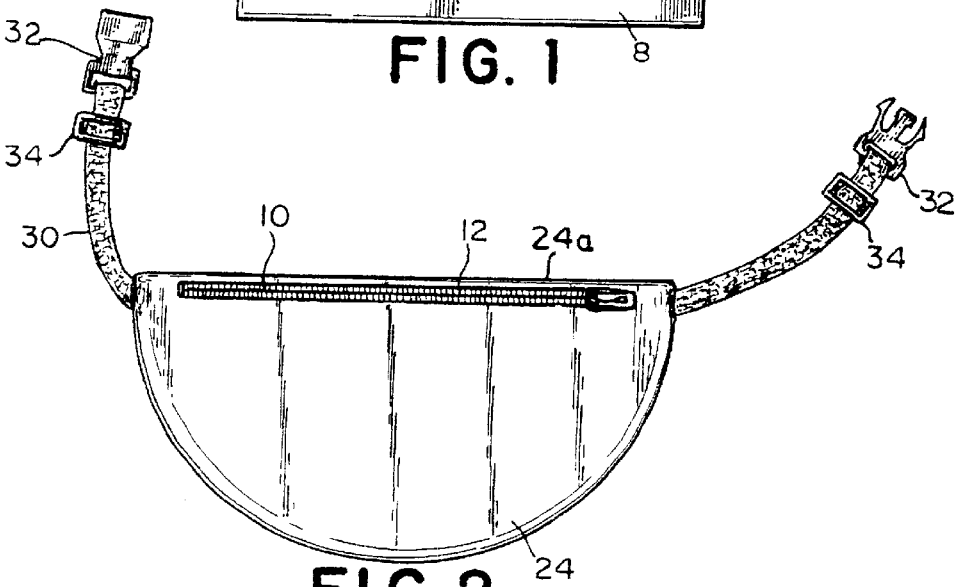
FIG. 2 is a perspective frontal view of a semicircular version of the waterproof swimming pouch constructed in accordance with the invention.

FIG. 2 shows enclosure 24 which forms a jacket completely surrounding a crescent-shaped waterproof inner pouch liner (not shown). Upper edge 24*a* of the enclosure 24 is shown with closure means 12 fixed in opening 10. Waist strap 30 is permanently attached to the enclosure left end portion and to the enclosure right end portion. The connector shown is a snap-type buckle 32 for securing the swimming pouch, and adjusters 34 are provided to allow the waist strap 30 to be shortened or lengthened. Enclosure 24 is formed in a crescent-shaped wedge, although any geometrical shape may be used.

Figure 3:
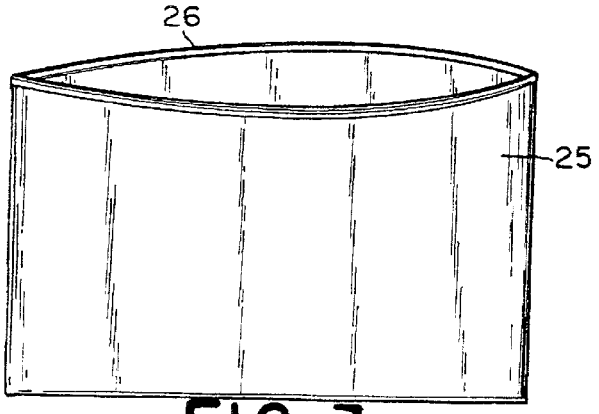
FIG. 3 is a view in perspective of a rectangular version of an inner pouch liner with resealable interlocking closure used in the waterproof swimming pouch of FIG. 1.

FIG. 3 shows an inner pouch liner 25, having a resealable interlocking closure 26. Waterproof enclosure 25 is formed in rectangular shape although any geometric shape may be used and is made of a durable waterproof plastic that has a resealable interlocking closure 26 generally known to those skilled in the art relating to closure fastening devices as demonstrated by the numerous patents in this area.

Figure 4:
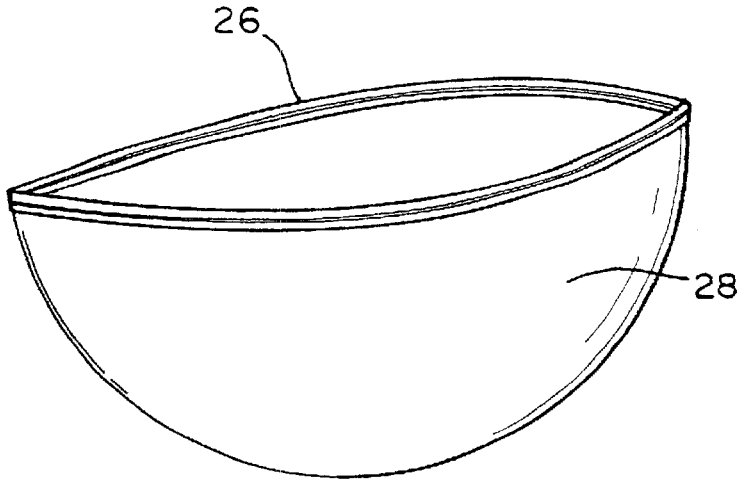
FIG. 4 is a view in perspective of a semicircular version of an inner pouch liner with resealable closure used in the waterproof pouch of FIG. 2.

FIG. 4 shows an alternative inner pouch liner 28. Enclosure 28 is formed in a crescent-shaped wedge shape, although any geometrical shape may be used, and is made of durable waterproof plastic that has resealable interlocking closure 26.

Figure 5:
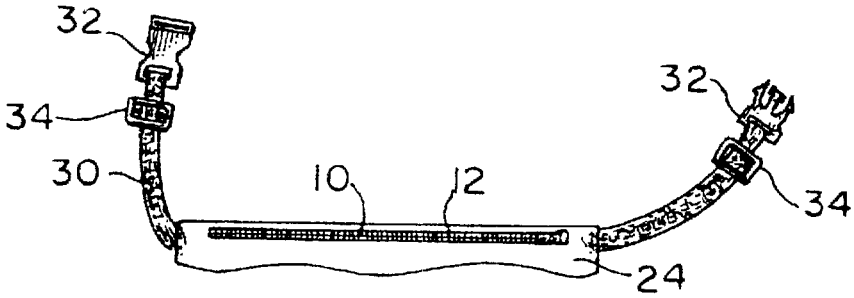
FIG. 5 is a frontal view of the upper edge portion of an inventive waterproof swimming pouch, showing the strap and connector.

FIG. 5 shows the upper edge portion of the enclosure 24, showing the fastener 12 in the form of a zipper and the strap 30 with snap-lock connector 32.

Figure 6:
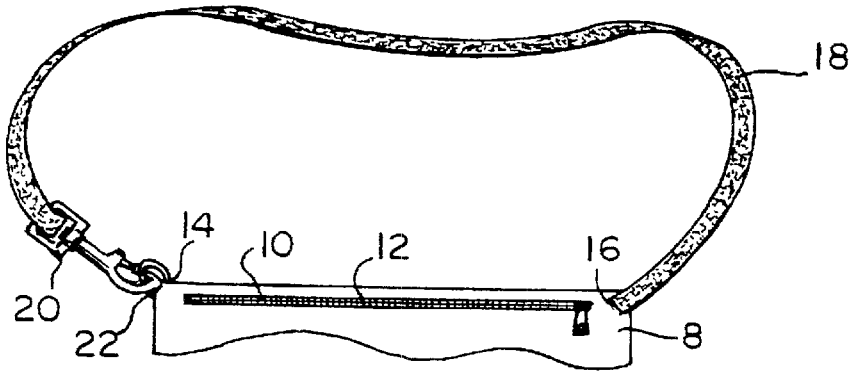
FIG. 6 is a frontal view of the upper edge portion of an inventive waterproof swimming pouch, showing an alternative strap and connector.

FIG. 6 is shows an alternative embodiment of the invention, with strap 18 being securely connected to the enclosure 8 by means of a spring-loaded swivel clip 20 and eye 22.

Figure 7:
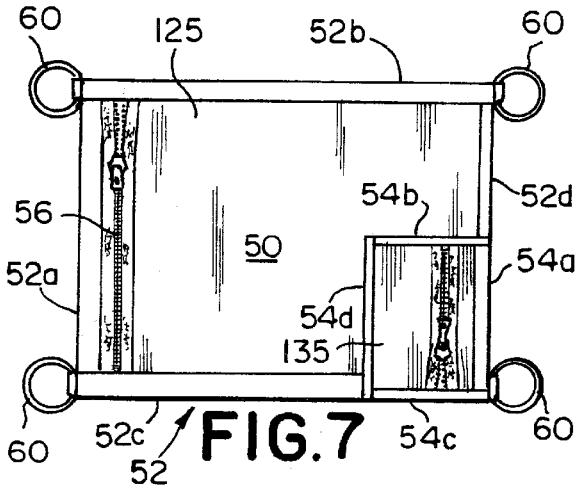
FIG. 7 is a top plan view of a waterproof map case in accordance with an embodiment of the invention.
Figure 8:
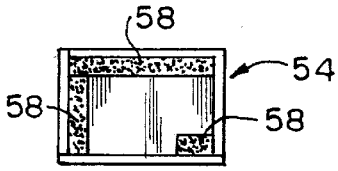
FIG. 8 is a bottom plan view of the accessory pouch of the map case of FIG. 7.
Figure 9:
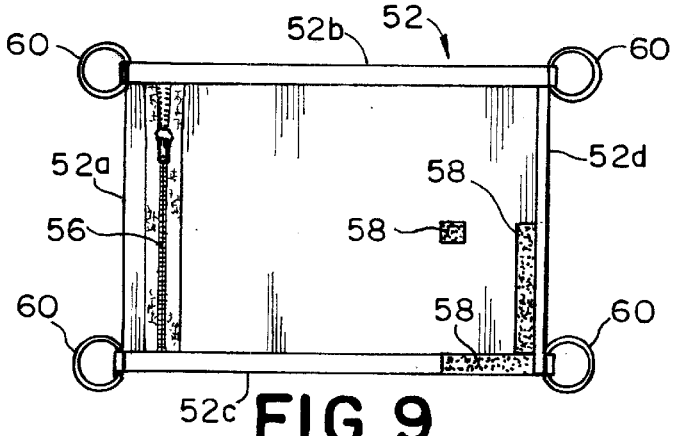
FIG. 9 is a top plan view of the map pouch of the map case of FIG. 7.
Figure 10:
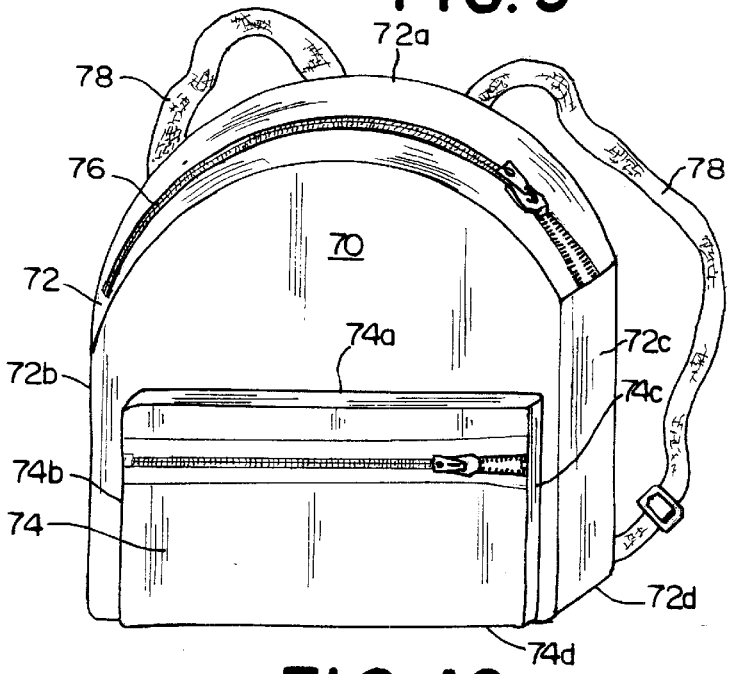
FIG. 10 is a front, perspective view of a waterproof backpack in accordance with an embodiment of the invention.
Figure 11:
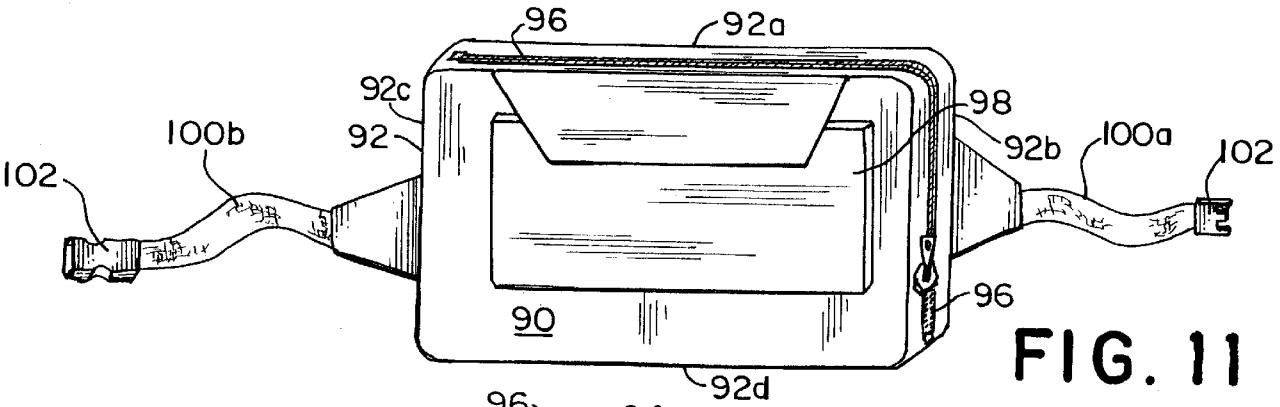
FIG. 11 is a front, perspective view of a waterproof waist bag in accordance with an embodiment of the invention; and, FIG. 12 is a top plan view of the waist bag shown in FIG. 11 in an unzipped and laid-out configuration.
Figure 12:
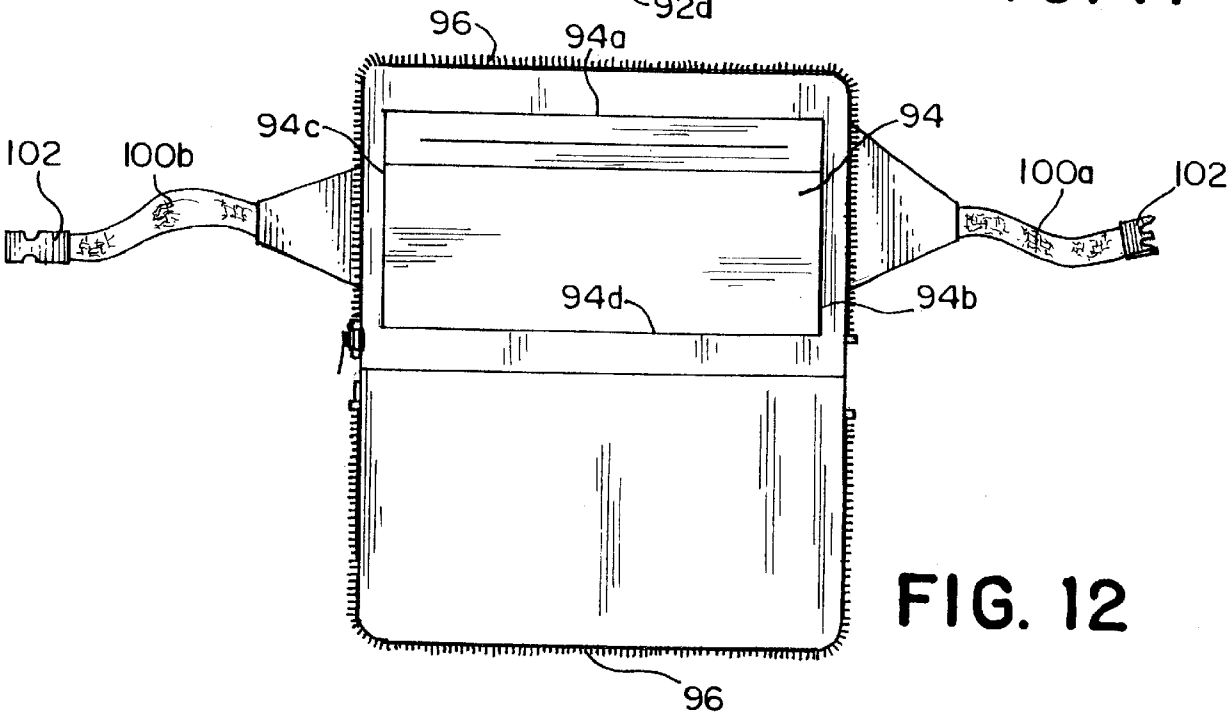

FIGS. 7–12 illustrate further embodiments of the invention, each of which include a waterproof, flexible pouch liner which forms a watertight compartment inside the pouch for keeping the contents dry. FIG. 7–9 illustrate a waterproof map case; FIG. 10 illustrates a waterproof backpack; and FIGS. 11–12 illustrate a waterproof waist bag.

Referring to FIGS. 7–9, the waterproof map case, designated generally by reference numeral 50, comprises a first pouch 52 and a second pouch 54. The first pouch is designed to contain an unfolded map (or at least a large unfolded portion of a map) and is therefore much larger than the above-described waterproof pouch. In a preferred embodiment, the first pouch 52 is approximately 18"×24".

The first pouch 52 is preferably formed of a flexible, transparent material such as clear vinyl. The first pouch 52 has an upper end portion 52*a*, first and second side portions 52*b*, 52*c*, and a bottom portion 52*d*. An opening is formed in the upper end portion 52*a*. The opening includes closure means formed at the opening for securely closing the opening when desired. In a preferred embodiment, the closure means comprises a zipper 56 attached to and extending across the entire length of the opening.

The first pouch 52 includes a waterproof, flexible pouch liner 125 inside the first pouch 52. The pouch liner 125 is also preferably made of a transparent material so that the map contained therein can be readily viewed by the user. The pouch liner 125 has the same construction as the pouch liner 25 described above. However, in this embodiment, the pouch liner 125 is approximately the same size as the inside dimension of the first pouch 52. The pouch liner 125 has an opening in one end and resealable, interlocking, watertight closure means at the opening. The pouch liner 125 forms a watertight compartment inside the first pouch 52 for keeping the map dry.

The waterproof map case 50 also comprises a second pouch 54 for storing map accessories. Preferably, the second pouch 54 is also formed of a flexible, transparent material such as transparent vinyl. The second pouch 54 has an upper end portion 54*a*, first and second side portions 54*b,c,* and a bottom portion 54*d*.

The second pouch 54 has a waterproof, flexible pouch liner 135 inside the second pouch 54. The pouch liner 135 has the same construction as the pouch liner 25 described above. The pouch liner 135 has an opening in one end and resealable, interlocking, watertight closure means. The pouch liner 135 forms a watertight compartment inside the second pouch for keeping the map accessories dry.

The waterproof case 50 has releasable fasteners holding the first pouch 52 and the second pouch 54 together. The releasable fasteners may comprise snaps, buttons or preferably VELCRO (a trademark of Velcro USA, Inc.) tabs 58 fixed to opposed outer surfaces of the first and second pouches. Referring to FIGS. 8 and 9, the VELCRO tabs or strips 58 are provided on the outer surface of both the first and second pouches and are aligned so that the second pouch may be fastened to the bottom corner of the first pouch 52.

The water proof case 50 also has releasable fasteners attached to each of the corners for suspending or carrying the case 50. In a preferred embodiment, the releasable fasteners comprise closed-looped hooks 60 firmly secured to each corner of the first pouch 52.

Referring to FIG. 10, a waterproof backpack, designated generally by reference numeral 70, comprises a first pouch 72 and a second pouch 74. The first pouch 72 is designed to contain a variety of articles larger than might be carried in the waterproof swimming pouch described above. In a preferred embodiment, the first pouch is approximately 12"×12".

The first pouch 72 is formed of a flexible material such as knitted cotton, polyester, nylon, or vinyl. The first pouch 72 has an upper end portion 72*a*, first and second side portions 72*b*, 72*c*, and a bottom portion 72*d*. An opening is formed in the upper end portion 72*a*. The opening includes closure means formed at the opening for securely closing the opening when desired. In a preferred embodiment, the closure means comprises a zipper 76 attached to and extending across the entire length of the opening.

The second pouch 74 is also preferably formed of a flexible material such as knitted cotton, nylon, polyester or vinyl. The second pouch 74 is preferably smaller than and fixed to the outside of the first pouch 72. The second pouch has an upper end portion 74*a*, first and second side portions 72*b*, 72*c*, and a bottom portion 74*d*.

The second pouch 74 has waterproof, flexible pouch liner 145 for keeping the contents of the second pouch dry. The pouch liner 145 is approximately the same size as the inside dimension of the second pouch 74. The pouch liner 145 has an opening in one end and a resealable, interlocking, watertight closure means at the opening. The pouch liner 145 forms a watertight compartment inside the second pouch 74 for keeping the contents contained therein dry.

The waterproof backpack 70 also has straps fixed thereto for carrying or suspending the pack. In a preferred embodiment, the carrying straps comprise a pair of adjustable shoulder straps 78 fixed to the outside of the first pouch 72.

Referring to FIGS. 11 and 12, a waterproof waist bag, designated generally by reference numeral 90, comprises a first pouch 92 and a second pouch 94. The first pouch 92 is formed of a flexible material such as knitted cotton, nylon, polyester or vinyl. The first pouch has an upper end portion 92*a*, first and second side portions 92*b*, 92*c*, and a bottom portion 92*d*. An opening is formed in the upper end portion 92*a* and both side portions 92*b*, 92*c*. The opening includes closure means formed at the opening for securely closing the opening when desired. In a preferred embodiment, the closure means comprises a zipper 96 attached to and extending across the entire length of the opening.

The waterproof waist bag also has a second pouch formed of a flexible material. The second pouch has an upper end portion 94*a*, first and second side portions 94*b*, 94*c*, and a bottom portion 94*d*. Preferably, the second pouch is fixed to the inside of the first pouch as best seen in FIG. 12.

The second pouch 94 has a waterproof, flexible pouch liner 155 inside the second pouch 94. The pouch liner 155 has the same construction as the pouch liner 25 described above. The pouch liner 155 has an opening in one end and a resealable interlocking, watertight closure means. The pouch liner 155 forms a watertight compartment inside the second pouch 94 for keeping the contents contained therein dry.

The waterproof waist bag 90 may also include a third pouch 98 fixed to the front, outer surface of the first pouch 92.

The waterproof waist bag 90 includes a two-piece belt 100 fixed to the first pouch 92 for holding the pouch around a wearer's waist. Each piece of the belt 100*a*, 100*b*, has one end fixed to the first pouch 92 and a free end. The belt 100 has a connector for releaseably locking the free ends of the belt. In a preferred embodiment, the connector comprises a snap-lock connector 102 or may comprise a buckle and eye.

In the preferred embodiment, the second pouch 94 does not contain closure means (such as a zipper) as illustrated in the previous embodiments since the second pouch 94 is contained within the first pouch 92. However, for added security, the second pouch 94 may also be provided with a zipper attached to and extending across the entire length of the opening.

What is claimed is:

1. A waterproof map case comprising:

a) a first pouch formed of flexible material, the first pouch having:
   i) an upper end portion, first and second side portions, and a bottom portion;
   ii) an opening formed in the upper end portion of the first pouch;
   iii) closure means formed at the opening for securely closing the opening when desired;

b) a waterproof, flexible pouch liner inside said first pouch, said liner pouch having:
   i) an opening in one end of the pouch liner; and,
   ii) resealable, interlocking, watertight closure means at the opening for forming a water tight compartment inside the first pouch for keeping the map dry;

c) a second pouch formed of flexible material, the second pouch having:
   i) an upper end portion, first and second side portions, and a bottom portion;
   ii) an opening formed in the upper end portion of the second pouch;
   iii) closure means formed in the upper end portion of the second pouch; and, d) a waterproof, flexible pouch liner inside said second pouch, said pouch liner having:
   i) an opening in one end of the liner pouch;
   ii) resealable, interlocking, watertight closure means at the opening for forming a watertight compartment inside the second pouch for keeping the contents contained therein dry.

2. The case recited in claim 1, the flexible material of said first pouch and said pouch liner inside said first pouch being transparent.

3. The case recited in claim 1, including resealable connectors attached to each corner of said first pouch.

4. The case recited in claim 1, said closure means comprising a zipper.

5. The case recited in claim 1, said resealable interlocking closure means comprising an interlocking watertight plastic strip.

6. The case recited in claim 1, said second pouch being smaller than said first pouch and being releasably fixed to the outside of said first pouch.

7. The case recited in claim 6, including a releasable fastener holding said first pouch and said second pouch together.

8. The case recited in claim 7, said releasable fastener comprising opposed velcro tabs fixed to said first and second pouches.

9. A method of carrying, using, and keeping dry a map while engaging in water activities using a waterproof map case, said map case comprising:

a) a first pouch formed of a transparent, flexible material, the first pouch having:
   i) an upper end portion, first and second side portions, and a bottom portion;
   ii) an opening formed in the upper end portion of the first pouch;
   iii) closure means formed at the opening for securely closing the opening when desired;

b) a transparent, waterproof, flexible pouch liner inside said first pouch, said liner pouch having:
   i) an opening in one end of the pouch liner; and,
   ii) resealable, interlocking, watertight closure means at the opening for forming a water tight compartment inside the first pouch for keeping the map dry;

c) a second pouch formed of flexible material, the second pouch having:
   i) an upper end portion, first and second side portions, and a bottom portion;
   ii) an opening formed in the upper end portion of the second pouch;
   iii) closure means formed in the upper end portion of the second pouch; and, d) a waterproof, flexible pouch liner inside said second pouch, said pouch liner having:
   i) an opening in one end of the liner pouch;
   ii) resealable, interlocking, watertight closure means at the opening for forming a watertigh compartment inside the second pouch for keeping the contents contained therein dry.

comprising the steps of:

a) inserting an unfolded map into the transparent, waterproof flexible pouch liner inside said first pouch;

b) closing said resealable, interlocking, watertight closure means at the opening of said pouch liner;

c) closing the closure means formed at the opening of the first pouch; and, d) viewing the map through said map case.

* * * * *